US008508130B2

(12) United States Patent
Sawada

(10) Patent No.: US 8,508,130 B2
(45) Date of Patent: Aug. 13, 2013

(54) SHORT ARC TYPE DISCHARGE LAMP

(75) Inventor: Aiko Sawada, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/572,150

(22) Filed: Aug. 10, 2012

(65) Prior Publication Data

US 2013/0043787 A1 Feb. 21, 2013

(30) Foreign Application Priority Data

Aug. 10, 2011 (JP) ..... 2011-175111

(51) Int. Cl.
*H01J 17/04* (2006.01)

(52) U.S. Cl.
USPC ..... 313/632; 313/631; 313/491

(58) Field of Classification Search
USPC ..... 313/491, 631, 632
See application file for complete search history.

(56) References Cited

U.S. PATENT DOCUMENTS 5,889,370 A 3/1999 Arai et al.
2008/0007177 A1 1/2008 Nishiaki et al.

FOREIGN PATENT DOCUMENTS

JP 09-253042 A 9/1997
JP 2008-016389 A 1/2008

*Primary Examiner* — Vip Patel
(74) *Attorney, Agent, or Firm* — Rader, Fishman & Grauer PLLC

(57) ABSTRACT

A short arc type discharge lamp that includes a body member a light permeable member a pair of an anode and a cathode. The pair of the anode and cathode is arranged with a gap at a focal position of the reflective face. The cathode has a cathode tip portion that is approximately conic and a cathode rod portion. The anode has an anode tip portion that has a tapering portion and a flat tip end portion. Further, an outer diameter of the tip of the anode flat tip end portion is smaller than the outer diameter of the cathode rod portion, and an outer diameter of a back end of the anode tip portion is larger than that of the cathode rod portion.

4 Claims, 6 Drawing Sheets

RELATED ART

SHORT ARC TYPE DISCHARGE LAMP

CROSS-REFERENCES TO RELATED APPLICATION

This application claims priority from Japanese Patent Application Serial No. 2011-175111 filed Aug. 10, 2011, the contents of which are incorporated herein by reference in their entirety.

TECHNICAL FIELD

The present invention relates to a short arc type discharge lamp, and in particular, relates to a short arc type discharge lamp used as a light source of medical equipment such as an endoscope.

BACKGROUND

In a short arc type discharge lamp, transparent ceramics, silica glass, or other glass material are used for an arc tube generally. In special circumstances; however, that a lamp main body may be is made from opaque ceramics, while only a light extracting section is made of transparent ceramics. Further, these short arc type discharge lamps generally have an appearance configuration that is columnar and very solid. And do to the easy to handle and high safety properties, short art type discharge lamps are used as a light source for medical treatments. For example, Japanese Patent Application Publication No. 2008-016389 discloses a short arc type discharge lamp used as an endoscope light source.

Yet, because such a short arc type discharge lamp used for a light source of an endoscope generates a radiation noise during lamp lighting, adverse result are created for other surrounding on electronic devices. Therefore, in a light source apparatus for an endoscope, a shield member for shielding a radiation noise is employed. Japanese Patent No. 3523749 discloses a light source apparatus for an endoscope equipped with such a shield member.

However, in recent years, further demand for miniaturization of such endoscopes caused the above-mentioned solution to not be desirable. Therefore, a different solution is desired to prevent or suppress the generation of such a radiation noise.

SUMMARY

In view of the above, it is an object of the present invention to offer a short arc type discharge lamp that prevents the generation of a radiation noise generated from a lamp.

After earnest studies, the inventors discovered that the incidence rate of such a radiation noise relates to the temperature of the tip of an anode. Specifically, the inventors found that when the temperature of the tip of anode is comparatively low, generation of such a radiation noise decreases remarkably.

In order to solve the above-mentioned problem, a short arc type discharge lamp comprises a body member made from an insulating member includes an electrical discharge space and a concave portion that forms the outer bounder of the electrical discharge space and a curved reflective face, a light permeable member that closes a front opening of the body member, and a pair of an anode and a cathode that is arranged in the electrical discharge space and form a gap therebetween at a focal position of the curved reflective face. The cathode includes a cathode tip portion that is approximately conic and a cathode rod portion that is continuous from the cathode tip portion. The anode has an anode tip portion that contains a tapering portion and a flat tip portion. The tapering portion tapers toward the flat tip portion. An outer diameter of the flat tip portion of the anode is smaller than an outer diameter of the cathode rod portion. An outer diameter of a back end of the anode tip portion, which is a back end of the tapering portion, is larger than the outer diameter the cathode rod portion.

The anode may contain an anode body portion that is continuous from the anode tip portion, a narrow portion that is continuous from the anode body portion, and a base portion that is continuous from the narrow portion. An outer diameter of the anode body portion is smaller than an outer diameter of the anode base portion, and the outer diameter of the anode body portion is larger than an outer diameter of the anode narrow portion.

BRIEF DESCRIPTION OF THE DRAWING

Other features and advantages of the short arc type discharge lamp will be apparent from the ensuing description, taken in conjunction with the accompanying drawings, in which.

DESCRIPTION

As a result of earnest study of the present inventors, it was discovered that an incidence rate of a radiation noise relates to temperature of the tip of an anode, and it was found that generation of a radiation noise becomes remarkable specifically when the anode tip is comparatively low in temperature. Therefore, in the present invention, such generation of the radiation noise is prevented by devising the shape of an anode so that the tip of the anode may become comparatively high in temperature at time of lamp lighting when a certain lighting current is supplied.

Figure 6A:
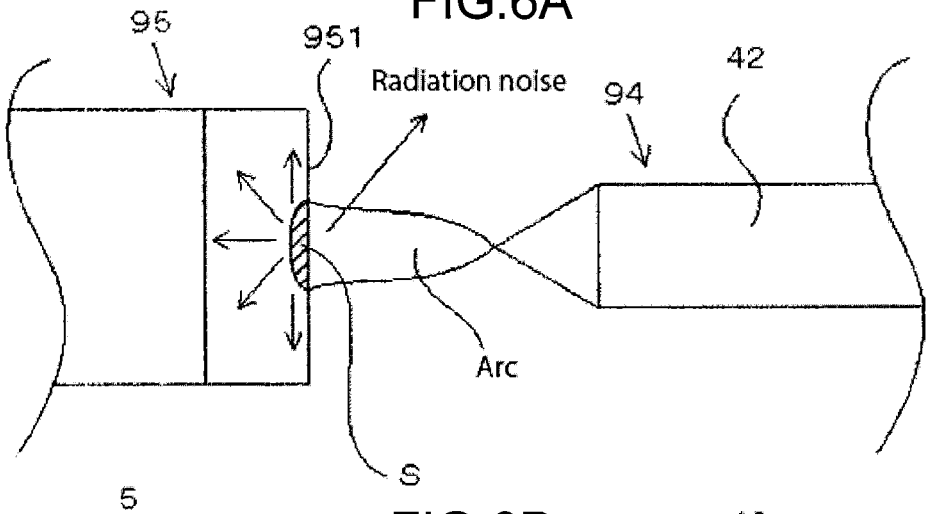
FIG. 6A is a short arc type discharge lamp.
Figure 6B:
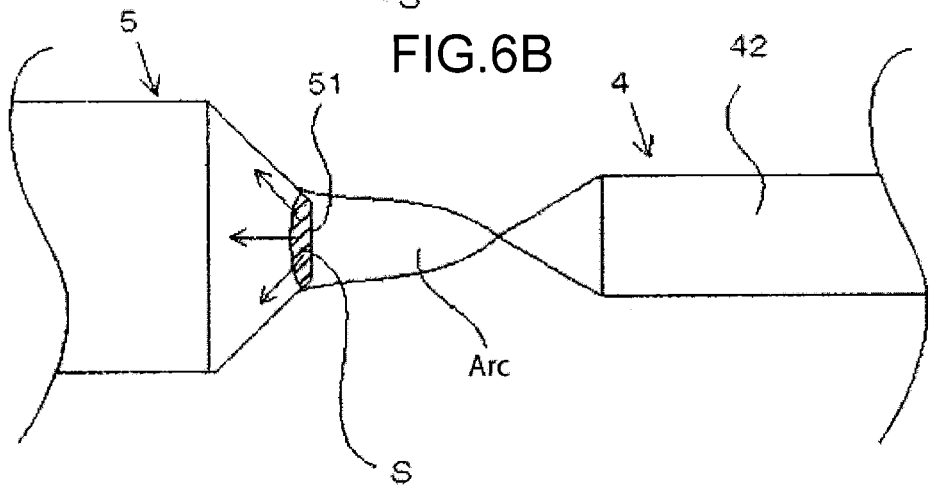
FIG. 6B is a conceptual diagram of thermal diffusion that arises at each anode tip of a short arc type discharge lamp.

An arc is formed from a cathode toward an anode between the cathode and the anode at time of lamp lighting, and current (energy) concentrates on the tip of the anode and a contact portion of the arc (hereinafter referred to as an arc spot), whereby heat is generated within the arc spot so that the heat is diffused inside the anode. FIGS. 6A and 6B show conceptional views regarding thermal diffusion at the tip of the anode. FIG. 6A shows electrodes in which the outer diameter of a flat portion 951 formed at the tip of an anode is larger than the outer diameter of a cathode core rod 94. FIG. 6B shows electrodes in which the outer diameter of a flat portion 51 formed at the tip of an anode is smaller than the outer diameter of the cathode core rod 42. If they are compared, since in FIG. 6B, the flat portion 51 formed at the tip of the anode has a small diameter, thermal diffusion from an arc spot S is comparatively reduced to the FIG. 6A case. Therefore, the flat portion 51 formed at the tip of the anode maintains a comparatively high temperature state, thereby suppressing generation of a radiation noise.

The extent of the radiation noise generated from the tip of the anode is influenced, depending on lighting conditions. Specifically, if current supplied to a lamp is reduced, a radiation noise is notably generated. Conversely, if the current is increased, generation of a radiation noise is reduced, and if it exceeds a certain threshold value, a radiation noise disappears. The anode tip can be maintained at a comparatively high temperature by adopting the lamp according to the present invention, so that it is possible to suppress generation of a radiation noise. In other words, the threshold value of the supply current (hereinafter referred to as a noise disappearance value), in which the radiation noise disappears, can be lowered largely.

Description of a short arc type discharge lamp according to the present invention will be given below.

Figure 1B:
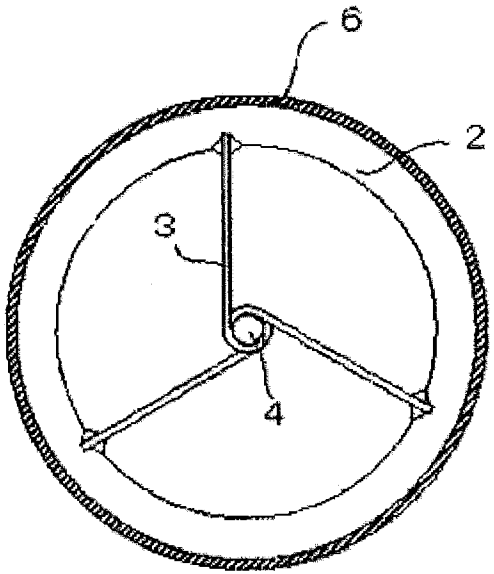
FIG. 1B is a cross sectional view thereof taken along a line IB-IB of FIG. 1A.
Figure 1A:
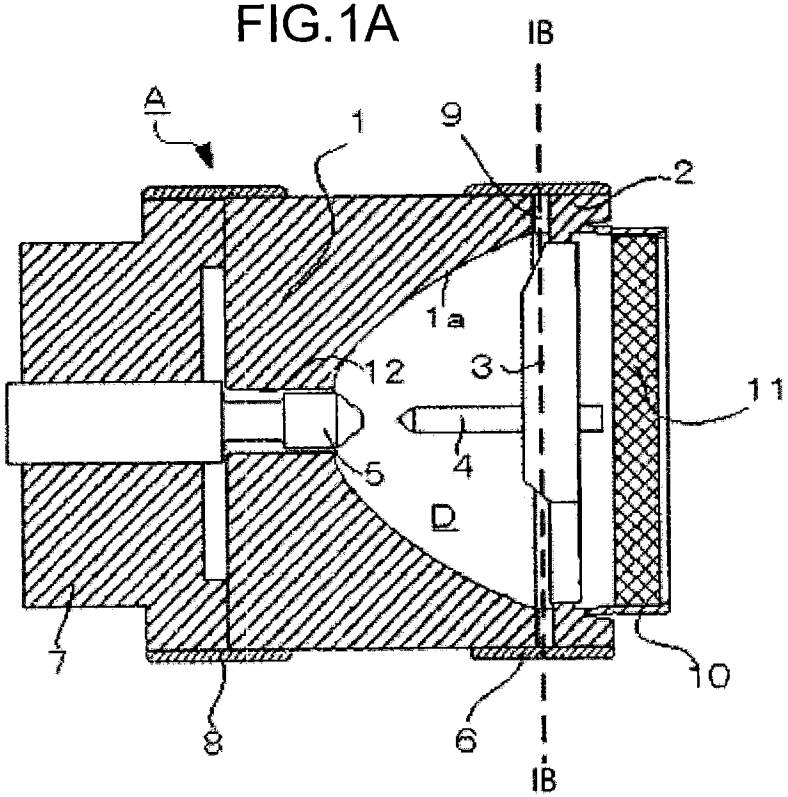
FIG. 1A is a partial sectional view of the appearance of a short arc type discharge lamp according to a first embodiment of the present invention.
Figure 3:
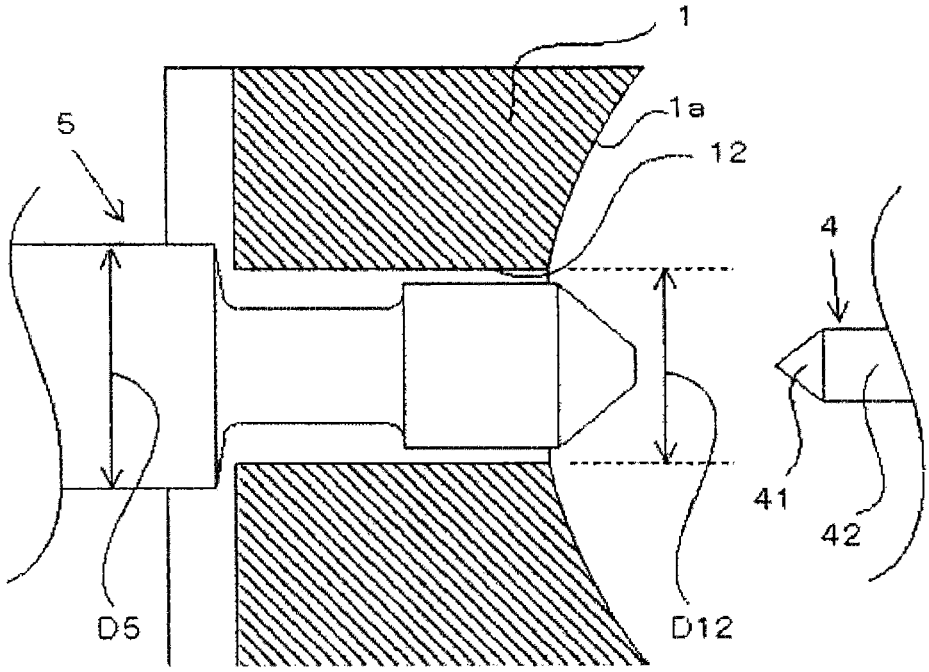
FIG. 3 is an enlarged view of a portion near a through hole of a short arc type discharge lamp shown in FIG. 1.

FIG. 1A shows a partial cross sectional view of a part of appearance of a short arc type discharge lamp according to a first embodiment. FIG. 1B shows a cross sectional view thereof taken along a line IB-IB shown in FIG. 1A. Moreover, FIG. 3 shows an enlarged view of a through hole portion 12 shown in FIG. 1. A cathode 4 and an anode 5 are arranged to face each other inside a sealed body portion of the lamp. A taper portion is formed on the cathode tip portion 41 so that the diameter is smaller toward the tip, and the cathode tip portion 41 is formed in an approximately conical shape. Moreover, a taper is also formed in an anode tip portion 52. A flat portion 51, which is perpendicular to an anode axis, is formed on the tip side of the taper section. The anode tip portion 52 is formed in the shape of an approximately truncated cone.

Figure 2:
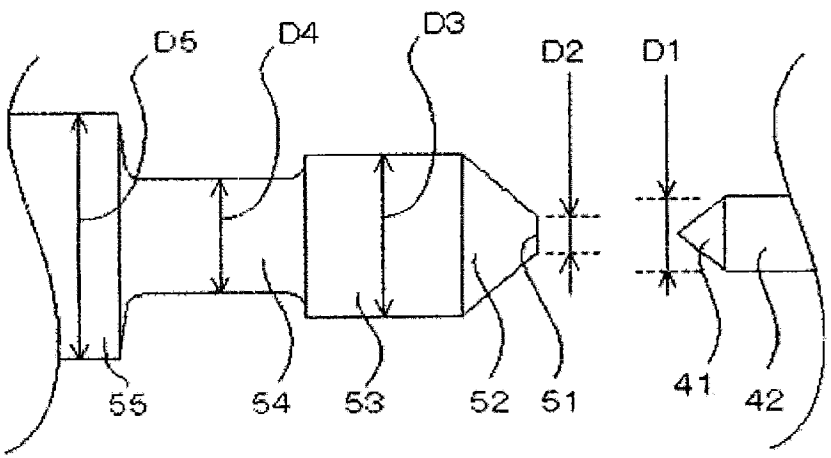
FIG. 2 is an outline view of the shapes of electrodes of a short arc type discharge lamp shown in FIG. 1.

FIG. 2 is an outline view of the shapes of electrodes of the short arc type discharge lamp shown in FIG. 1. The anode tip portion 52 is in an approximately truncated cone shape, and the flat portion 51 is formed on a front side of the anode tip portion 52. The outer diameter D2 of the flat portion 51 is smaller than the outer diameter D1 of the cathode core rod part 42, and the tip portion of each electrode is formed so that the outer diameter D3 of the anode body portion 53 may be larger than the outer diameter D1 of the cathode core rod portion 42. That is, the outer diameter of each part of the electrodes is designed to satisfy the relative magnitude relation of D2<D1<D3. By such design, the anode tip becomes comparatively high in temperature and radiation noise is prevented.

An electric discharge space of the lamp is formed inside the short arc type discharge lamp according to the present invention, wherein the electric discharge space is formed by a concave body member 1 having a curved reflection face 1*a* and a light-permeable member which closes a front opening thereof. The body member 1 is made from an insulating member, which may be made of alumina, and has an outer diameter of, for example, approximately 30 mm in size. The reflection face 1*a* provided on the body member 1 is formed to have a parabola face to obtain a high directivity optical output. In addition, the reflection face 1*a* may also be formed to have an ellipsoid or aspheric surface. Moreover, in order to raise reflection efficiency thereof, metal, such as silver and aluminum, may be vapor-deposited on the reflection face 1*a*. Further, a dielectric multilayer film may be formed instead of the metal vapor-deposited film. The electric discharge space D is formed on an inner side of the reflection face 1*a*, and the cathode 4 and the anode 5 are arranged to have a gap therebetween, to face each other, and to be aligned on the optical axis of the reflection face 1*a*. The cathode 4 and the anode 5 may be are made of tungsten.

One side face of a ceramic ring 9, which has an outer diameter almost equal to the outer diameter of the body member 1, is brought in contact with a tip edge of the body member 1, continuing to the front opening of the reflection face 1*a*. And a power supply ring 2, which has an outer diameter almost equal to the outer diameter of the body member 1, is arranged near the opening edge of the reflection face 1*a*. Specifically, the power supply ring 2 is arranged on another side of the ceramic ring 9. A ring-like flange 10 is inserted to be in contact with an inner face of the power supply ring 2. The flange 10 has a transparent circular window member 11 on an inner circumference side. This window member 11 is made of sapphire, since it is impact resistant and has a high visible-light permeability. Moreover, the flange 10 is made of kovar whose thermal expansion coefficient is close to that of sapphire.

The ceramic ring 9 and the power supply ring 2 are in contact with the tip portion of the body member 1, and they are fixed by a first metallic member 6. The first metallic member 6 is connected with the power supply ring 2, and electric power is supplied to the cathode 4 through the first metallic member 6. Moreover, the metallic block 7 is arranged to be in contact with a rear end portion of the body member 1, and they are fixed by a second metallic member 8. The anode 5 is inserted in the center of the metallic block 7, and electric power is supplied to the anode 5 through the metallic block 7. Moreover, the metallic block 7 and the anode 5 are brazed so that the metallic block 7 and the anode 5 may be fixed to each other.

A through hole portion 12 is formed along with the optical axis of the reflection face 1*a* in the center of the body member 1 so that the anode 5 may be inserted in this through hole portion 12 and fixed to the metallic block 7. Moreover, the cathode 4 is fixed by a support member 3 so that a distance between the cathode 4 and the anode 5 may be maintained. The taper angle of approximately 30 to 70 degree is formed in the tip portion of the cathode 4 to achieve, for example, good electron emission, and is suitably adjusted depending on a lamp.

The magnitude relation of the outer diameter of each part of the anode 5 and the cathode 4 shown in FIG. 1 is shown in FIG. 2. The anode 5 of the short arc type discharge lamp according to the first embodiment is mainly made up of four parts, that is, the anode tip portion 52 that includes of the flat portion 51 and a taper portion, the anode body portion 53 that is continuously formed from the tip portion 52, a narrow portion 54 that is continuously formed from the body portion 53, and a base portion 55 that is continuously formed from the narrow portion 54.

The anode tip portion 52 is in a truncated cone shape, and the flat portion 51 is formed on a front side of the anode tip portion 52. The tip portion of each electrode is formed so that the outer diameter D2 of the flat portion 51 may be smaller than the outer diameter D1 of the cathode core rod portion 42, and the outer diameter D3 of the anode body portion 53 may be larger than the outer diameter D1 of the cathode core rod portion 42. That is, the outer diameter of each part of the electrodes is designed so that the relative magnitude relation may be set to D2<D1<D3. Thus, it is possible to prevent generation of a radiation noise.

Since the outer diameter D2 of the front side of the anode tip portion 52 is formed to be smaller than the outer diameter D1 of the cathode core rod portion 42, the thermal diffusion is suppressed in the front portion of the anode tip portion 52, and thermal capacity thereof near the flat portion 51 becomes small, and temperature of the tip of the anode tends to rise at time of lamp lighting. Compared with a lamp shown in FIG. 7, the flat portion 51 of the anode tends to be comparatively high in temperature, and generation of a radiation noise from an anode tip is suppressed. Moreover, since the outer diameter D3 of the anode body portion 53 is formed to be larger than the outer diameter D1 of the cathode core rod portion 42, the anode tip is prevented from being heated more than needed and from being melted. That is, the extent of the thermal diffusion is adjusted by changing the shape of the anode tip portion 52, and the front portion of the tip of the anode, which is a source of a radiation noise, is maintained to be comparatively high in temperature so that generation of the radiation noise is prevented.

Moreover, the narrow portion 54, which is continuously formed from the anode body portion 53, and the base portion 55, which is continuously formed from the narrow portion 54, are provided in the anode 5 according to the first embodiment. This anode base portion 55 is a part to be joined with the metallic block 7 of a lamp sealed body A, and specifically, the metallic block 7 and the anode base portion 55 are brazed, so that the anode 5 is being fixed thereto. The outer diameter D4 of the narrow portion 54 is smaller than the outer diameter D3 of the anode body portion 53, and the outer diameter D5 of the anode base portion 55, which is continuously formed from the narrow portion 54, is larger than the outer diameter D3 of the anode body portion 53. That is, the magnitude relation of the outer diameter of each part of the anode is designed to be set to D4<D3<D5.

As mentioned above, since the outer diameter D4 of the narrow portion 54 is formed smaller than the outer diameter D3 of the anode body portion 53, the heat dam effect can be brought about between the anode body portion 53 and the narrow portion 54, whereby the thermal diffusion (heat) from the anode body portion 53 to the narrow portion 54 is dammed up, and the heat transfer to the anode base portion 55 is suppressed. Moreover, the outer diameter D5 of the anode base portion 55 is formed larger than the outer diameter D3 of the anode body portion 53, so that the thermal capacity of the anode base portion 55 becomes comparatively large, whereby the anode base portion 55 is unlikely to be affected by the heat transfer from the anode body portion 53. Therefore, this prevents fault arising in the brazed portion of the anode base portion 55 whose heat resistance is poor, and the metallic block 7. Specifically, cracks or melting of brazing material can be prevented.

FIG. 3 is an enlarged view of the through hole portion shown in FIG. 1. The outer diameter D3 of the anode body portion 53 is smaller than the outer diameter D5 of the anode base portion. Furthermore, it is also possible to form the anode body portion 53 so that the outer diameter D3 may be smaller than the outer diameter D953 of an anode core rod 953 of the lamp shown in FIG. 7B. In such case, the pore diameter D12 of the through hole portion 12, which is formed in the body member, can be designed smaller than the lamp in FIGS. 7A and 7B, so that the reflection face of the mirror 1*a* can be expanded, and the radiation light of a lamp can be more effectively utilized. For example, the pore diameter D12 can be designed about 1 mm smaller than that of the lamp shown in FIG. 7B. Thereby, the light intensity of the lamp, which is used, can be increased about more than 10% (and less than 20%).

In the short arc type discharge lamp, while generation of a radiation noise is suppressed by setting the magnitude relation of the outer diameter of tip portion of the cathode and that of the anode, diffusion of the heat generated in the anode tip portion is controlled by changing the outer diameter of each part of the anode, so that the structure thereof may be suitable for a light source for devices (e.g. endoscopes). That is, the present invention is characterized in the relative magnitude relation of the outer diameter of each part of the electrodes.

Figure 4:
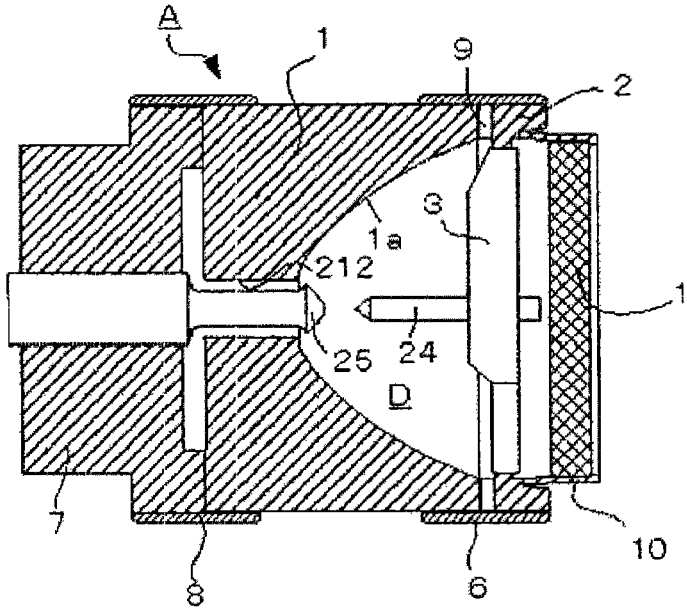
FIG. 4 is a partial cross sectional view of the appearance of a short arc type discharge lamp according to a second embodiment.
Figure 5:
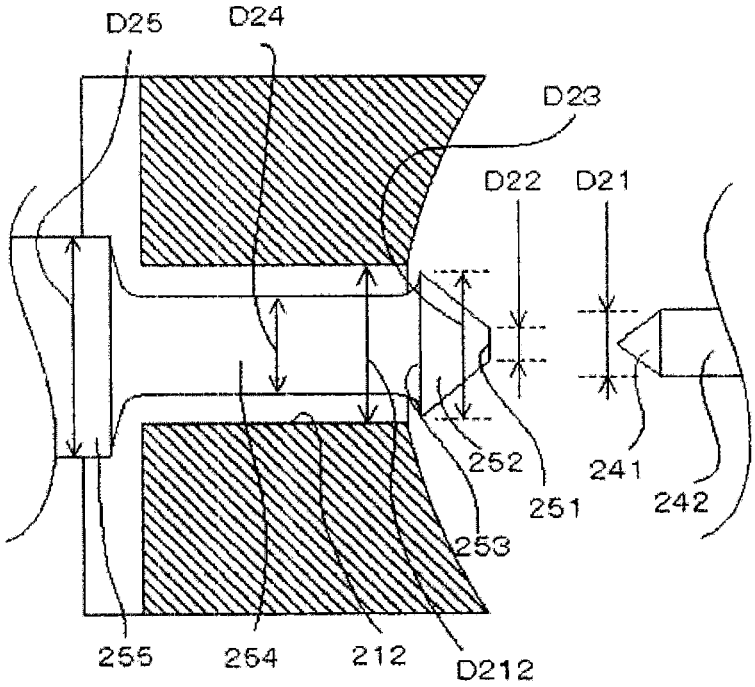
FIG. 5 is an enlarged view of a part near a through hole of a short arc type discharge lamp shown in FIG. 4.

FIG. 4 is a partial cross sectional view of the appearance of a short arc type discharge lamp according to a second embodiment. FIG. 5 is an enlarged view of a part near a through hole portion of the short arc type discharge lamp shown in FIG. 4. In the second embodiment, the shape of the anode according to the first embodiment shown in FIG. 3 is modified. A taper portion is formed in a cathode tip portion 241, and the cathode tip portion 241 is formed in an approximately conical shape. Moreover, a taper portion is also formed in the anode tip portion 252, and the anode tip portion 252 is formed in the shape of a truncated cone. A flat portion 251, which is perpendicular to an anode axis, is formed on a front side of the anode tip portion 252.

A rear part of the anode tip portion 252 is formed so that the outer diameter D23 may be larger than the outer diameter D21 of the cathode core rod part 242. Moreover, the flat portion 251 formed in a front part of the anode tip portion 252 is formed so that the outer diameter D22 may be smaller than the outer diameter D21 of the cathode core rod part 242. That is, the outer diameter of each part of the anode 25 and the cathode 24 is set to satisfy the magnitude relation of D22<D21<D23. Therefore, generation of a radiation noise is suppressed by making the temperature at the tip of the anode easily rise, and, the heat generated at the anode tip is diffused promptly. Thus, melting of the anode tip portion 252 is prevented.

In the second enforcement, a portion corresponding to the anode body portion 53 shown in the first embodiment is not provided in the anode 25, and the anode 25 is made up of the anode tip portion 252, a narrow portion 254 that is continuously formed from the anode tip portion 252, and a base portion 255 that is continuously formed from the narrow portion 254. The base portion 255 of the anode is a portion, in which the metallic block 7 of a lamp sealed body A is inserted, and the anode base portion 255 is brazed to the metallic block 7, so that the anode is fixed thereto.

The anode body portion 53 in the first embodiment is not formed in the anode according to the second embodiment. Therefore, the narrow portion 254, which is continuously formed from the anode base portion 255, is formed to be comparatively long. Moreover, the outer diameter D25 of the anode base portion 255 is designed larger than the outer diameter D23 of a bottom of the truncated cone shape of the anode tip portion 252, and the outer diameter of each part of the anode 25 to satisfies the magnitude relation of D24<D23<D25.

EMBODIMENT

Although description of an embodiment will be given below, the present invention is not limited thereto.

Embodiment 1

The short arc type discharge lamp according to the present invention, which had the structure shown in FIG. 1, was prepared on conditions set forth below. A cathode (4) was made of tungsten, had a diameter of 1.5 mm, and a full length of 15 mm. An anode (5) was made of tungsten and had a taper angle of 90 degrees. The outer diameter (D2) of a flat portion was 1 mm. The outer diameter (D3) of an anode body portion was 3.5 mm. The outer diameter (D4) of a narrow portion was 3 mm. The outer diameter (D5) of a base portion was 4 mm. The full length thereof was 23. The pore diameter of a through hole portion (D12) was ϕ4.7 mm. As the usage environment of a lamp, current was 20 A and voltage was 14 V.

Comparative Example 1

Figure 7B:
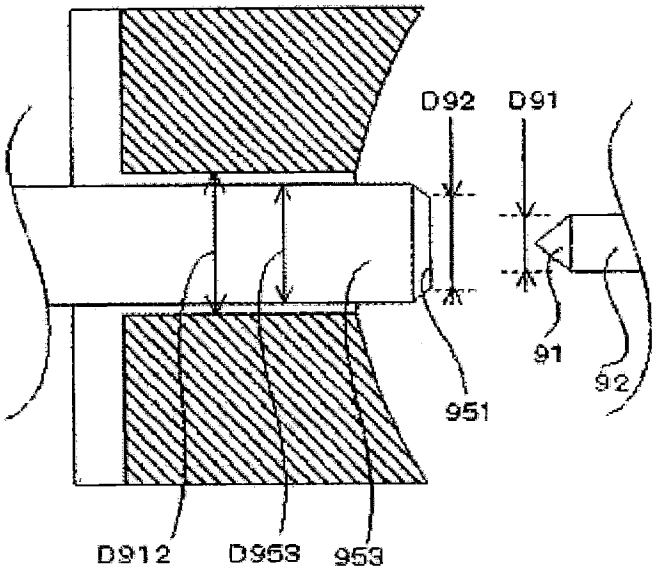
FIG. 7B is an enlarged view of a part near a through hole of FIG. 7A.
Figure 7A:
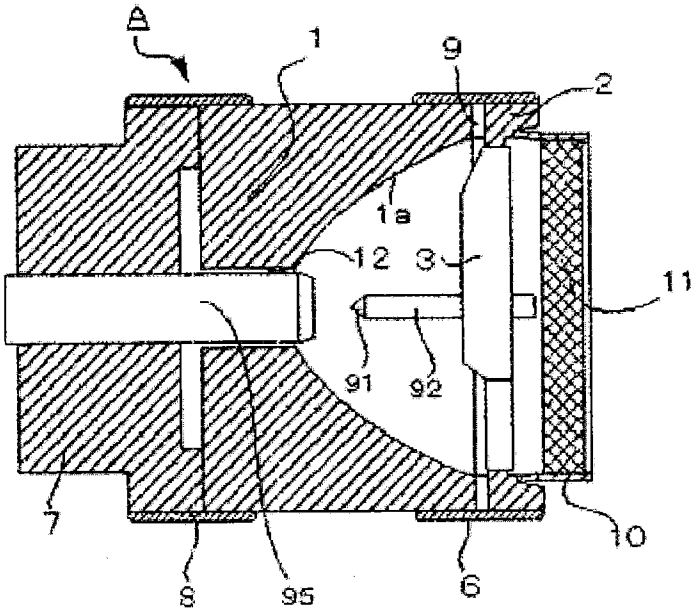
FIG. 7A is a partial sectional view of the appearance of a short arc type discharge lamp of related art.

According to the structure shown in FIGS. 7A and 7B, a short arc type discharge lamp was prepared according to conditions set forth below. A cathode (94) was made of tungsten, was 1.5 mm in diameter, and was 15 mm in full length. An anode (95) was made of tungsten. The outer diameter (D951) of a flat portion was 3.5 mm and the full length thereof was 23 mm. The outer diameter of an anode core rod portion (D953) thereof was 4 mm. The pore diameter of a through hole portion (D912) was ϕ5.6 mm. As the usage environment of a lamp, current was 20 A and voltage was 14 V.

Evaluation 1

Lamp voltage is disturbed if a radiation noise occurs. Therefore, it was possible to detect generation of a radiation noise by monitoring lamp voltage at time of lamp lighting. When the short arc type discharge lamp according to Embodiment 1 and that of Comparative Example 1 were turned on under desired lighting conditions (current: 20 A, voltage: 14 V), radiation noise was generated in Comparative Example 1 and was not generated in Embodiment 1. Moreover, a noise disappearance value of the radiation noise of each of Embodiment 1 and Comparative Example 1 was examined. When the lamp was lighted in Embodiment 1 and Comparative Example 1, the supply current of the lamps were gradually increased from 16 A to 24 A to turn them on, and the existence of the radiation noise in each supply current value was checked, while the noise disappearance value of the radiation noise was examined. See Table 1.

TABLE 1

| | Noise Disappearance Value |
|---|---|
| Embodiment 1 | 17.8 A |
| Comparative Example 1 | 22.1 A |

As seen in Table 1, it was found in Embodiment 1 that the noise disappearance value could be lowered compared with Comparative Example 1 and that generation of a radiation noise in the short arc type discharge lamp could be suppressed.

Evaluation 2

The light amount increasing rate in the case of Embodiment 1 was obtained on the basis of Comparative Example 1. Since the pore diameter of Embodiment 1 was designed 1 mm smaller than the through hole portion of Comparative Example 1, the reflection face la formed inside the lamp sealed body could be formed larger, so that light amount could be increased compared with the Comparative Example 1. A difference in a light amount increasing rate arose depending on the diameter of a fiber by which light from a lamp was guided, and the thinner the diameter of the fiber, the better light amount was obtained. Specifically, as compared with Comparative Example 1, light amount increased by about 20% in Embodiment 1.

The short arc type lamp according to the present invention is characterized by the above electrode structure, wherein generation of the radiation noise generated from an anode tip can be suppressed. Moreover, according to this electrode structure, the pore diameter of the through hole portion of the body member can be designed smaller than that of the other lamps, so that the amount of radiation lights can be increased.

Since the outer diameter of the anode flat tip portion is smaller than that of the cathode rod portion and the outer diameter of the back end of the tapering portion is larger than that of the cathode rod portion, the thermal diffusion of the front side of the anode tip portion is suppressed, which keeps the temperature of the flat tip portion comparatively high and prevents the generation of a radiation noise. Moreover, heat generated in the back end can be diffused into the inside of the anode promptly. Thus, it is possible to prevent the anode tip portion from being consumed in an early stage.

In addition, when the anode has the anode tip portion, the anode body portion, the narrow portion, and the base portion, with the outer diameter of the anode body portion being smaller than that of the base portion and the outer diameter of the anode body portion being larger than that of the narrowed portion, the narrow portion of the anode has a heat dam effect. Thus, it is possible to suppress heat that is conducted to the anode base portion and that is produced in the anode tip portion. Moreover, since the outer diameter of the anode tip portion and that of the narrowed portion may be made smaller than that of the base portion, it is possible to design a small pore diameter of a through hole portion.

The preceding description has been presented only to illustrate and describe exemplary embodiments of the present short arc type discharge lamp. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. A short arc type discharge lamp, comprising:

a body member that comprises an electrical discharge space and a concave portion, the concave portion forms the outer bounder of the electrical discharge space and a curved reflective face;

a light permeable member that closes a front opening of the body member; and a pair of an anode and a cathode that is arranged in the electrical discharge space and forms a gap therebetween at a focal position of the curved reflective face;

the cathode comprises a cathode tip portion that is approximately conic and a cathode rod portion that is continuous from the cathode tip portion, the anode comprises an anode tip portion that contains a tapering portion and a flat tip portion, the tapering portion tapers toward the flat tip portion, an outer diameter of the flat tip portion is smaller than an outer diameter of the cathode rod portion, and an outer diameter of a back end of the anode tip portion is larger than the outer diameter the cathode rod portion.

2. The short arc type discharge lamp according to claim 1, wherein the anode comprises an anode body portion that is continuous from the anode tip portion, a narrow portion that is continuous from the anode body portion, and a base portion that is continuous from the narrow portion, wherein an outer diameter of the anode body portion is smaller than an outer diameter of the base portion, and wherein the outer diameter of the anode body portion is larger than an outer diameter of the narrow portion.

3. A short arc type discharge lamp, comprising:

an anode and a cathode;

the cathode comprises a cathode rod portion, the anode comprises an anode tip portion that contains a tapering portion and a flat tip portion, the tapering portion tapers toward the flat tip portion, an outer diameter of the flat tip portion is smaller than an outer diameter of the cathode rod portion, and an outer diameter of a back end of the anode tip portion is larger than the outer diameter the cathode rod portion.

4. The short arc type discharge lamp according to claim 3, wherein the anode comprises an anode body portion that is continuous from the anode tip portion, a narrow portion that is continuous from the anode body portion, and a base portion that is continuous from the narrow portion, wherein an outer diameter of the anode body portion is smaller than an outer diameter of the base portion, and wherein the outer diameter of the anode body portion is larger than an outer diameter of the narrow portion.

* * * * *